US011511330B2

(12) United States Patent
Tobita et al.

(10) Patent No.: US 11,511,330 B2
(45) Date of Patent: Nov. 29, 2022

(54) METHOD FOR MANUFACTURING PRESS FORMED PRODUCT

(71) Applicant: JFE Steel Corporation, Tokyo (JP)

(72) Inventors: Shunsuke Tobita, Tokyo (JP); Toyohisa Shinmiya, Tokyo (JP); Yuji Yamasaki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 16/957,122

(22) PCT Filed: Dec. 17, 2018

(86) PCT No.: PCT/JP2018/046409

§ 371 (c)(1),
(2) Date: Jun. 23, 2020

(87) PCT Pub. No.: WO2019/131289

PCT Pub. Date: Jul. 4, 2019

(65) Prior Publication Data

US 2020/0346269 A1 Nov. 5, 2020

(30) Foreign Application Priority Data

Dec. 25, 2017 (JP) ..... JP2017-247992

(51) Int. Cl.
*B21D 22/26* (2006.01)
*B21D 19/00* (2006.01)
*B21D 37/16* (2006.01)

(52) U.S. Cl.
CPC ..... *B21D 22/26* (2013.01); *B21D 19/00* (2013.01); *B21D 37/16* (2013.01)

(58) Field of Classification Search
CPC ..... B21D 37/16; B21D 19/00; B21D 22/022; B21D 22/16; B21D 22/26; B21D 22/208;
(Continued)

(56) References Cited

U.S. PATENT DOCUMENTS 4,122,700 A * 10/1978 Granzow ..... B21D 22/02 72/342.3
5,735,163 A 4/1998 Sato et al.
(Continued)

FOREIGN PATENT DOCUMENTS

CN 106064193 A 11/2016
EP 2233593 A2 * 9/2010 ..... B21D 22/022
(Continued)

OTHER PUBLICATIONS

Extended European Search Report for European Application No. 18 897 134.5, dated Feb. 4, 2021, 7 pages.
(Continued)

*Primary Examiner* — Adam J Eiseman
*Assistant Examiner* — Matthew Stephens
(74) *Attorney, Agent, or Firm* — RatnerPrestia

(57) ABSTRACT

A press formed product is disclosed. A method for manufacturing the press formed product is a method for manufacturing the press formed product including applying press processing including stretch flange forming to a single metal sheet of one sheet material after performing shearing processing of the metal sheet to manufacture the press formed product. When a region where a stretch flange crack is estimated to be likely to occur when the single metal sheet is press formed by the press processing is set as a stretch flange crack region, the press processing is applied after heating and cooling the end surface of the metal sheet positioned in the stretch flange crack region and at least the end surface in the end surface and the vicinity thereof in the single metal sheet after the shearing processing.

4 Claims, 2 Drawing Sheets

(58) Field of Classification Search
CPC ..... B21D 24/16; B21D 53/88; C21D 1/30; C21D 1/673; C21D 9/46; C21D 8/0205
See application file for complete search history.

(56) References Cited

U.S. PATENT DOCUMENTS

| | | | | |
|---|---|---|---|---|
| 9,758,848 | B2 * | 9/2017 | Kawasaki | C22C 38/16 72/342.3 |
| 10,010,917 | B2 | 7/2018 | Sato et al. | |
| 2014/0144560 | A1 * | 5/2014 | Yamano | C22C 38/58 148/654 |
| 2015/0014386 | A1 * | 5/2015 | Sato | B21C 37/00 72/342 |
| 2017/0333971 | A1 * | 11/2017 | Denks | B21D 22/022 72/342 |
| 2019/0119768 | A1 * | 4/2019 | Schleichert | C21D 1/34 72/342.3 |

FOREIGN PATENT DOCUMENTS

| | | | | |
|---|---|---|---|---|
| EP | 3023168 | A1 | 5/2016 | |
| EP | 3238845 | A1 | 11/2017 | |
| JP | 08117879 | A | 5/1996 | |
| JP | 2783490 | A | 8/1998 | |
| JP | 2001323318 | A | 11/2001 | |
| JP | 2002113527 | A | 4/2002 | |
| JP | 2004124151 | A | 4/2004 | |
| JP | 2010227954 | A | 10/2010 | |
| JP | 2019073763 | A | 5/2019 | |
| WO | WO-2008101567 | A1 * | 8/2008 | B21D 37/16 |
| WO | 2013171884 | A1 | 11/2013 | |
| WO | WO-2018091039 | A1 * | 5/2018 | C22C 38/26 |
| WO | 2019131289 | A1 | 7/2019 | |

OTHER PUBLICATIONS

International Preliminary Report on Patentability and Written Opinion for International Application No. PCT/JP2018/046409, dated Jun. 30, 2020, 7 pages.
International Search Report and Written Opinion for International Application No. PCT/JP2018/046409, dated Feb. 26, 2019, 5 pages.
Chinese Office Action with Search Report for Chinese Application No. 201880083421.1, dated Jun. 28, 2021, 7 pages.

* cited by examiner

METHOD FOR MANUFACTURING PRESS FORMED PRODUCT

CROSS REFERENCE TO RELATED APPLICATIONS

This is the U.S. National Phase application of PCT/JP2018/046409, filed Dec. 17, 2018, which claims priority to Japanese Patent Application No. 2017-247992, filed Dec. 25, 2017, the disclosures of these applications being incorporated herein by reference in their entireties for all purposes.

FIELD OF THE INVENTION

The present invention relates to a method for manufacturing a press formed product including reducing a risk of a stretch flange crack in press forming a metal sheet, and then applying press processing to the metal sheet to manufacture a press formed product. The present invention is a technology suitable particularly for the manufacturing of car body structural components for automobiles.

BACKGROUND OF THE INVENTION

In recent years, in order to achieve an improvement of collision safety and a weight reduction of an automobile body, a high tensile strength steel sheet of 590 MPa or more has been increasingly applied to car body structural components. The high tensile strength steel sheet has a low hole expansion ratio, and therefore poses a problem of forming defects, such as a stretch flange crack, when press forming is performed.

As one of press formed products to be used for automobile undercarriage components, a structure component having a shape of being curved in a plan view, such as a lower arm, is mentioned, for example. When such a component shape curved in a plan view is processed by press forming, there is a risk that the stretch flange crack occurs in a curved portion.

When mass-producing automobile components by the press forming, a press processing process is performed after performing shearing processing, such as a trimming process or a piercing process, in many cases. In this case, the stretch flange crack is likely to occur from a sheared end surface edge formed by the trimming process or the piercing process.

When the high tensile strength steel sheets are applied to the component shape or the forming process described above, particularly the stretch flange crack tends to occur.

As a conventional technology relating to the stretch flange crack, PTL 1 to PTL 3 are mentioned, for example.

A method described in PTL 1 is a technology of preventing the stretch flange crack occurring when a high strength steel sheet is press formed. PTL 1 describes that, when the steel sheet is subjected to stretch flange forming with this technology, the steel sheet temperature during the forming is increased to 400° C. or more and 1000° C. or less, whereby dynamic recovery of the dislocation occurs during processing, so that the deposition of dislocation becomes difficult to occur, and thus the stretch flange crack is suppressed.

A method described in PTL 2 is a technology of applying tempering treatment of increasing mechanical strength to a predetermined part of a sheet-like panel as a press raw material to improve formability in press processing. PTL 2 describes that this technology can suppress a crack caused by stress concentration occurring with the progress of the press processing.

A method described in PTL 3 is a technology of press forming a combined blank material produced by, in a state where end portions of a plurality of sheet materials are butted, irradiating butting edges thereof with laser light to weld end portions. PTL 3 describes that, when the welded end positions and the vicinity thereof of the sheet materials are press-processed into a curved shape in a plan view by the press forming, softening treatment is applied to sheet material peripheral portions including the welded end portions and the vicinity thereof by emitting laser light thereto for annealing before the press processing. It is described that the treatment inhibits the occurrence of the stress concentration in the sheet material peripheral portions, facilitates the stretching of a softened part in the press forming, and prevents the stress concentration on the welded end portions.

PATENT LITERATURES

PTL 1: JP 2002-113527 A
PTL 2: JP 8-117879 A
PTL 3: Japanese Patent No. 2783490

SUMMARY OF THE INVENTION

However, according to the method described in PTL 1, the steel sheet during the press forming is heated, and therefore a heating device is required to be incorporated in a die, which complicates the die shape. Furthermore, due to the fact that the steel sheet is heated to 400° C. or more and 1000° C. or less, the die is easily damaged, and thus there is a possibility that the mass-production cost increases.

The method described in PTL 2 is a method for increasing the strength to suppress a crack, and thus is difficult to be applied to a stretch flange crack requiring stretching. The method is unsuitable particularly for high tensile strength steel sheets having high tensile strength.

The method described in PTL 3 is a method for dispersing a strain of a stretch flange crack risk region to suppress the stretch flange crack near the welded portion. However, the method described in PTL 3 does not describe the heating temperature or a heating region of each material and the condition of the steel type and has a possibility that sufficient stretch flange formability cannot be obtained by local stretch flange forming. Moreover, according to the method described in PTL 3, the softening treatment is performed for preventing a crack in the welded end portions, and therefore there is a risk that a region to which heat treatment is applied becomes a relatively wide region.

Aspects of the present invention have been made in view of the above-described respects. It is an object according to aspects of the present invention to provide a press formed product in which a stretch flange crack can be suppressed and forming defects are suppressed without complicating the die shape and without applying heat treatment more than necessary.

In order to solve the problems, a method for manufacturing a press formed product which is one aspect of the present invention includes applying press processing including stretch flange forming to a single metal sheet obtained by shearing one sheet material to manufacture a press formed product, in which, when a region where a stretch flange crack is estimated to be likely to occur when the single metal sheet is press formed through the press processing is set as a stretch flange crack region, in the stretch flange crack region in the single metal sheet obtained by the shearing, at least an end surface out of a whole part of the end surface and the vicinity thereof in the metal sheet is heated and cooled, and then the press processing is applied to the single metal sheet.

One aspect of the present invention can provide a press formed product which can greatly reduce a crack risk of a component where the stretch flange crack occurs and in which forming defects are suppressed without applying heating to a region more than necessary. As a result, a component with good formability is obtained, which leads to an improvement of the yield.

BRIEF DESCRIPTION OF THE DRAWINGS

FIGS. 2A and 2B are figures explaining an example of a region where a stretch flange crack occurs, in which FIG. 2A illustrates a metal sheet and FIG. 2B illustrates an example of the press formed product;

DETAILED DESCRIPTION OF EMBODIMENTS OF THE INVENTION

Embodiments of the present invention will now be described below with reference to the drawings.

Figure 1:
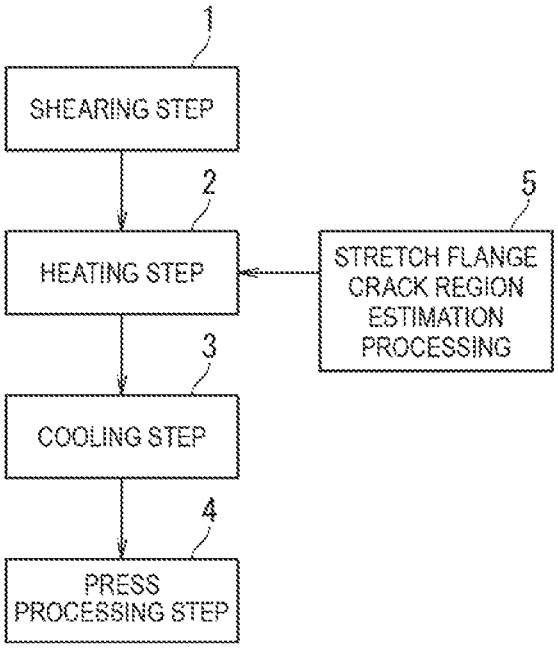
FIG. 1 is a figure explaining a process of manufacturing a press formed product according to an embodiment based on the present invention.

A method for manufacturing a press formed product in this embodiment includes a shearing process 1, a heating process 2, a cooling process 3, and a press processing process 4 in this order as illustrated in FIG. 1. Moreover, the method for manufacturing a press formed product in this embodiment has stretch flange crack region estimation processing 5.

The method for manufacturing a press formed product of this embodiment is effective particularly in the case that the metal sheet is a steel sheet having a tensile strength of 440 MPa or more. In this embodiment, as a metal sheet to be press-processed, a high tensile strength steel sheet of 440 MPa or more is targeted. However, this embodiment is applicable even in the case of metal sheets, such as a metal sheet of a steel sheet having a tensile strength of less than 440 MPa and an aluminum sheet.

<Shearing Process 1>

The shearing process 1 is a process of trimming the outer peripheral contour shape of a metal sheet of one sheet material formed by rolling or the like into a predetermined set shape or forming an opening portion by shearing to obtain a single metal sheet.

The "single metal sheet" in this embodiment does not mean a combined blank material obtained by bonding a plurality of sheets by welding but means a metal sheet containing the same metal material.

Herein, when the metal sheet is cut by shearing processing, an end surface is more seriously damaged than an end surface produced by machining, so that the end surface is uneven, and therefore the stretch flange formability decreases.

<Stretch Flange Crack Region Estimation Processing 5>

The stretch flange crack region estimation processing 5 is processing of specifying the position of a stretch flange crack region which is a region where a stretch flange crack is estimated to be likely to occur when the single metal sheet is press formed by the press processing process 4.

Such a stretch flange crack region (stretch flange crack risk part) may be specified through examination by CAE analysis based on the conditions of the press forming in the press processing process 4 or may be specified by actual pressing. In usual, a curved portion or a barring portion in a plan view, for example, is the stretch flange crack region. Therefore, a flange portion whose curvature radius is equal to or larger than a predetermined curvature radius by press processing may be simply set as the stretch flange crack region in a region where stretch flange forming is performed.

<Heating Process 2>

The heating process 2 and the cooling process 3 as the following process are pretreatment before applying press processing including stretch flange forming to the single metal sheet after the shearing process 1.

The heating process 2 is a process of heating at least an end surface in the end surface and a vicinity of the end surface of the metal sheet of the metal sheet in the stretch flange crack region specified by the stretch flange crack region estimation processing 5.

In the heating process 2, after it is estimated that the temperature of the end surface of the metal sheet has reached the target heating temperature, the heated state may be held for a certain period of time. When the holding time is long, the manufacturing efficiency decreases, and therefore the holding time is preferably within 5 minutes. More preferably, the holding time is within 1 minute.

Only the end surface of the metal sheet in the stretch flange crack region may be heated. However, it is difficult to heat only the end surface. Therefore, it is preferable to perform setting so that a region as close as possible to the end surface out of a whole part of the end surface and the vicinity thereof is heated by laser, induction heating, or the like capable of performing local heating.

Considering mass production, it is difficult to heat the end surface of the metal sheet by laser. Therefore, it is preferable to heat the vicinity of the end surface from a surface side of the metal sheet.

For example, a heating range X [mm] from the end surface of the metal sheet on the surface of the single metal sheet is set within the range of Expression (1). More specifically, regions equal to or less than the heating range X [mm] are set as the end surface and the vicinity thereof.

$$0\ [\text{mm}] \leq X \leq 20\ [\text{mm}] \quad (1)$$

Herein, a case where the heating range X [mm] exceeds 20 mm is not preferable because there is a possibility that the fatigue properties of components decrease by the softening of the material strength (tensile strength). In the case of a device capable of heating only the vicinity of the end surface, the heating range X [mm] is more preferably within 5 mm.

From the viewpoint of suppressing a failure caused by the heating, the heating range X [mm] is preferably a range as close as possible to the end surface and is more preferably within the range of Expression (2) below.

$$0\ [\text{mm}] \leq X \leq 8\ [\text{mm}] \quad (2)$$

The heating method is not limited to the heating by laser and, for example, the heating may be performed by bringing a heating device, such as an induction coil, close to the end surface side of the metal sheet. However, the heating by laser is simple and preferable.

A heating temperature T [° C.] of a portion to be heated may be a temperature at which the softening of a material can occur at a heating position, and is, for example, set to an annealing temperature of a target metal.

The heating temperature (target heating temperature) is preferably set to 200° C. or more and equal to or less than the Ac1 point of the above-described metal sheet, for example.

The heating rate in the heating is preferably rapid heating.

Herein, a case where the heating temperature T [° C.] is equal to or higher than the Ac1 point of a material is not preferable because the transformation point is exceeded, and therefore, when rapid cooling is performed, the hardness increases and, on the contrary, there is a possibility that the stretch flange formability decreases. It is considered that, in the case of a metal, such as a common steel sheet, softening treatment is applied thereto by heating the same at 200° C. or more.

<Cooling Process 3>

The cooling process 3 is a process of cooling the end surface of the metal sheet and at least the end surface of the metal sheet in the end surface and the vicinity thereof of the metal sheet heated in the heating process 2.

The cooling treatment after the heating may be any one of rapid cooling by water cooling or the like, air cooling, and slow cooling. In the case of the rapid cooling, there is a possibility that the stretch flange formability decreases when the heating temperature is equal to or higher than the Ac1 point of a material. The air cooling may be natural air cooling or air cooling by blowing air from a nozzle. In the slow cooling, the cooling rate may be adjusted by adjusting the output in laser heating or induction heating.

In the cooling by the cooling process 3, the cooling is performed so that the temperature of the heated end surface of the metal sheet decreases to be lower by 30° C. or more than the target temperature of the heating, for example.

<Press Processing Process 4>

The press processing process 4 is a process of applying the press processing including the stretch flange forming to the metal sheet, the end surface of which has been subjected to the heating/cooling treatment, to obtain a press formed product of the target shape. The press formed product by the press processing process 4 may not be a final formed product.

<Operations and Others>

Figure 2A:
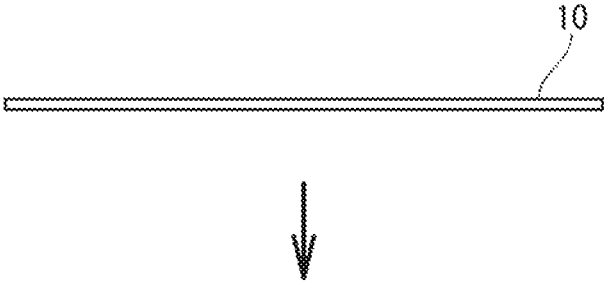
Figure 2B:
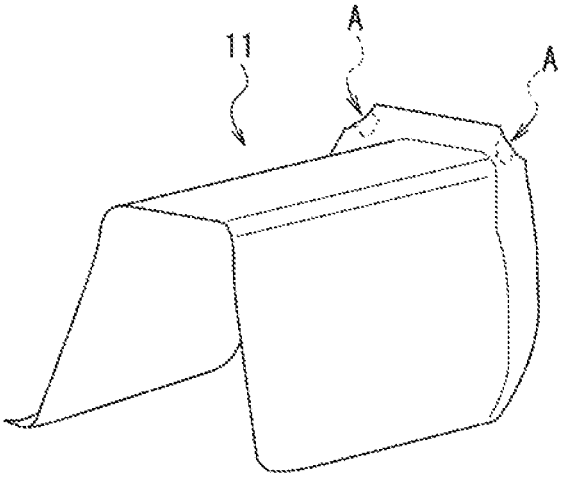

As illustrated in FIG. 2A, a blank material 10 containing a flat metal sheet was simply press-processed into a press formed product 11 as illustrated in FIG. 2B to which deformation by which a flange is stretched is given in the press forming. At this time, when the press forming is performed by applying the high tensile strength steel sheet to the metal sheet 10, the stretch flange crack occurred in parts illustrated by marks A in FIG. 2B. The presence or absence of the occurrence of the stretch flange crack is dependent on the material strength (tensile strength), the material structure, the sheared end surface state, surface treatment, and the like.

For example, in the case of a material of a composite structure observed in a ultra-high tensile strength steel sheet, the stretch flange formability decreases due to a structure hardness difference as compared with a material of a single phase structure.

The stretch flange formability is also dependent on a method for cutting a material end portion receiving the stretch flange deformation. When the metal sheet is cut by shearing processing, for example, a damage is larger than that in the end surface produced by machining, so that the end surface state is uneven, and therefore the stretch flange formability decreases. Furthermore, also in the case of the shearing processing, the stretch flange formability changes depending on a clearance.

In order to reduce the stretch flange crack occurring due to materials disadvantageous for the stretch flange forming or processing conditions, the method for manufacturing a press formed product of this embodiment performs the press forming after heating and cooling the end surface of the metal sheet which has been likely to serve as a crack starting point due to the shearing processing among the stretch flange crack risk regions.

As a result, in this embodiment, the heating/cooling as pretreatment achieves a structure change of the material of the stretch flange crack risk parts, i.e., softening or strain removal of the material, and thus the stretch flange formability is improved.

In particular, the heat treatment for softening the material is performed, and then cooling treatment is performed while targeting the end surface of the metal sheet and at least the end surface near the end surface, whereby a reduction in the fatigue properties of components accompanying the softening of the material strength (tensile strength) by the heating can be minimized.

When this embodiment is applied to a combined blank material containing a welded end portion obtained by welding two sheet materials as with PTL 3, there are the following problems when a region containing the welded end portion is the stretch flange crack region. More specifically, in this embodiment, the heat treatment and the subsequent cooling treatment are applied only to the end surface and the vicinity thereof, i.e., mainly the end surface. Therefore, when this embodiment is applied, there is a possibility that a crack occurs in the press forming in the end surface of the welded end portion where the tensile strength is relatively low. Therefore, this embodiment is not applicable to the manufacturing of a press formed product targeted to a metal sheet having a welded end portion in the stretch flange crack region.

Example 1

In order to confirm an improvement effect of the stretch flange formability by the press forming method according to aspects of the present invention, a hole expansion test was performed after partially heating/cooling a hole expansion test piece. The results are described below.

Figure 3:
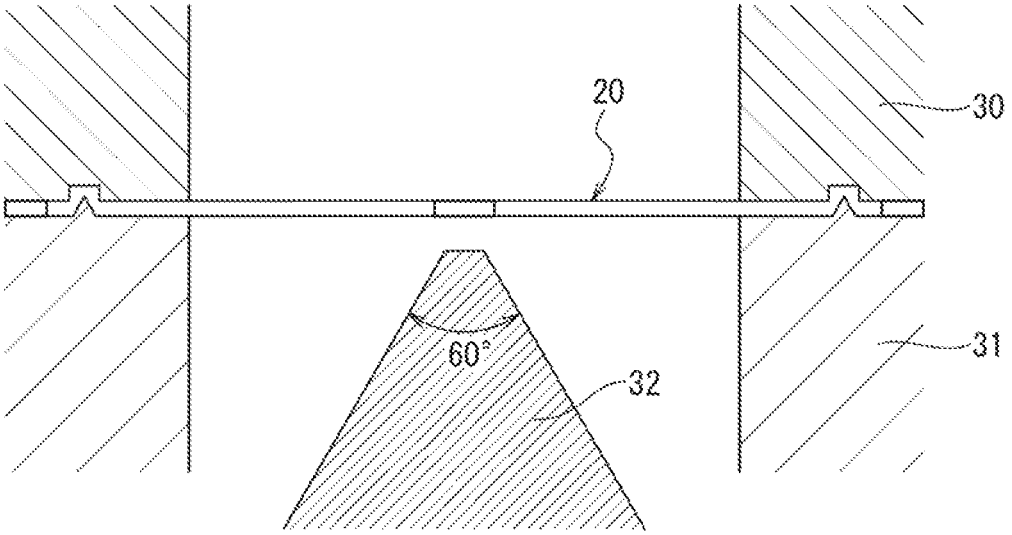
FIG. 3 is a schematic view of a hole expansion test.

In this example, the stretch flange formability was evaluated by the hole expansion test illustrated in FIG. 3. In FIG. 3, the reference numeral 20 designates a blank material, the reference numeral 30 designates a die, the reference numeral 31 designates a blank holder, and the reference numeral 32 designates a punch.

Figure 4:
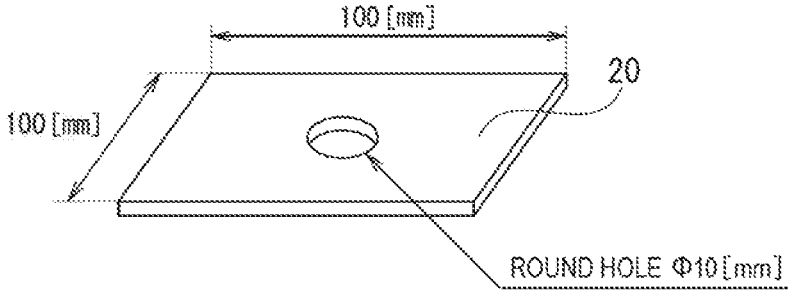
FIG. 4 is a schematic view of a hole expansion test piece.

First, as illustrated in FIG. 4, a ϕ10 [mm] hole was formed with a 12% clearance in the blank center of a 100 [mm]×100 [mm] square blank material to produce a hole expansion test piece (blank material 20 in FIG. 3). As a metal sheet configuring the blank material used in this example, a steel sheet having a sheet thickness t of 1.2 mm and tensile strength of 1180 MPa was used.

The produced hole expansion test piece was subjected to a hole expansion test by a conical punch 32 imitating the press processing including the stretch flange forming as illustrated in FIG. 3. The blank holder force was set to 8 ton.

At this time, the hole expansion tests were individually carried out on the condition that heat treatment was not performed (conventional method) and on the condition that the heat treatment was applied (in accordance with aspects of present invention) as pretreatment of the hole expansion test.

As the heating condition for the heat treatment, the surface side of the blank material 20 was heated using laser for a heating device and, as the heating region, an edge region within 1 mm or more and 8 mm or less from the metal sheet hole edge was set. As the heating temperature, the heating was individually performed on the conditions that the laser heating surface temperature was in the range of 200° C. or more and 700° C. or less.

The air cooling (cooling) was carried out by performing natural air cooling until the temperature of a heated portion heated with the heating device decreased to normal temperature.

Table 1 collectively illustrates the heating conditions and the hole expansion test results.

TABLE 1

| No. | Heating temperature [° C.] | Heating region [mm] | Hole expansion ratio [%} | Remarks |
|---|---|---|---|---|
| 1 | — | — | 23 | Conventional method |
| 2 | 200 | 1 | 26 | Present invention |
| 3 | 400 | | 38 | Present invention |
| 4 | 600 | | 89 | Present invention |
| 5 | 700 | | 112 | Present invention |
| 6 | 200 | 3 | 24 | Present invention |
| 7 | 400 | | 44 | Present invention |
| 8 | 600 | | 110 | Present invention |
| 9 | 700 | | 122 | Present invention |
| 10 | 200 | 5 | 26 | Present invention |
| 11 | 400 | | 45 | Present invention |
| 12 | 600 | | 117 | Present invention |
| 13 | 700 | | 124 | Present invention |
| 14 | 200 | 8 | 24 | Present invention |
| 15 | 400 | | 47 | Present invention |
| 16 | 600 | | 119 | Present invention |
| 17 | 700 | | 131 | Present invention |

As is understood from Table 1, No. 1 is a result of performing the hole expansion test to a non-heated sample, in which the hole expansion ratio was 23%. In contrast to this result, No. 2 to No. 5 based on the present invention are results of performing the hole expansion test after heating a range within 1 mm from the hole edge (end surface of the hole) by laser. It was found that the hole expansion ratio was improved No. 6 to No. 9 are results of performing the hole expansion test after heating a range within 3 mm from the hole edge by laser. No. 10 to No. 13 are results of performing the hole expansion test after heating a range within 5 mm from the hole edge by laser. No. 14 to No. 17 are results of performing the hole expansion test after heating a range within 8 mm from the hole edge by laser. It was found also in these cases that the hole expansion ratio was improved with an increase in the heating temperature as with No. 2 to No. 5.

As is understood from Table 1, when each heating temperature is high, a comparison of the influence of the heating region on the hole expansion ratio shows that the hole expansion ratio is improved when the heating region is larger within the range of the present invention. However, when a reduction in the fatigue properties of the components due to the softening of the material strength (tensile strength) caused by heating is considered, it is preferable to minimize the range of the heating region from the end surface in the range where the occurrence of the stretch flange crack can be suppressed. Moreover, from this viewpoint, it is preferable to also set the heating temperature in the range of 400° C. or more and 600° C. or less, for example.

Herein, this application claims the benefit of JP 2017-247992 A (filed Dec. 25, 2017), the entire contents of which form part of this disclosure by reference. Although the description is given referring to a limited number of embodiments herein, the scope of the present invention is not limited thereto. It is obvious for those skilled in the art to alter and modify the embodiments based on the disclosure above.

REFERENCE SIGNS LIST

1 shearing process
2 heating process
3 cooling process
4 press processing process
5 stretch flange crack region estimation processing
10 metal sheet (blank material)
11 press formed product
20 blank material

The invention claimed is:

1. A method for manufacturing a press formed product comprising:

applying press processing including stretch flange forming to a single metal sheet obtained by shearing one sheet material to manufacture a press formed product, analyzing the press processing of the single metal sheet to estimate where a stretch flange crack is likely to occur in an outer portion of the metal sheet;

setting a region in which the stretch flange crack has been estimated to be likely to occur in the outer portion of the metal sheet when the single metal sheet is press formed through the press processing as a stretch flange crack region, in the stretch flange crack region in the single metal sheet, heating and cooling a portion of an end surface and an area in a vicinity of the end surface of the metal sheet, and then processing the single metal sheet, wherein a heating temperature T [° C. ] of the portion of the end surface and the area in the vicinity of the end surface of the metal sheet on the surface is set to 200° C. or more and 600° C. or less, and wherein the portion of the end surface is heated for a period of time from 1 to 5 minutes.

2. The method for manufacturing a press formed product according to claim 1, wherein out of the portion of the end surface and the area in the vicinity of the end surface of the metal sheet on the surface of the single metal sheet on the surface of the single metal sheet, a heating range X [mm] from the end surface of the metal sheet is set within a range of Expression (1), $$0\ [\text{mm}] \leq X \leq 20\ [\text{mm}] \quad (1).$$

3. The method for manufacturing a press formed product according to claim 1, wherein the metal sheet is a steel sheet having tensile strength of 440 MPa or more.

4. The method for manufacturing a press formed product according to claim 3, wherein the metal sheet is a steel sheet having tensile strength of 440 MPa or more.

* * * * *